US008845140B2

(12) United States Patent
Lee et al.

(10) Patent No.: US 8,845,140 B2
(45) Date of Patent: Sep. 30, 2014

(54) HEAT SINK AND LAMP USING THE SAME

(75) Inventors: Hsuan-Hsien Lee, Taipei (TW); Vivienne Su, New Taipei (TW)

(73) Assignee: Edison Opto Corporation, New Taipei (TW)

( * ) Notice: Subject to any disclaimer, the term of this patent is extended or adjusted under 35 U.S.C. 154(b) by 184 days.

(21) Appl. No.: 13/557,204

(22) Filed: Jul. 24, 2012

(65) Prior Publication Data

US 2013/0107539 A1 May 2, 2013

(30) Foreign Application Priority Data

Oct. 31, 2011 (TW) ..... 100139602 A

(51) Int. Cl.

| | |
|---|---|
| ***F21V 29/00*** | (2006.01) |
| ***F21K 99/00*** | (2010.01) |
| ***F21V 29/02*** | (2006.01) |

(52) U.S. Cl.

CPC ..... *F21V 29/2293* (2013.01); *F21K 9/13* (2013.01); *F21V 29/027* (2013.01); *F21V 29/02* (2013.01)

USPC ..... 362/294

(58) Field of Classification Search

USPC ..... 362/294, 373, 547, 580, 126, 218, 264, 362/345

See application file for complete search history.

(56) References Cited

U.S. PATENT DOCUMENTS

| | | | | |
|---|---|---|---|---|
| 5,664,872 | A * | 9/1997 | Spearman et al. | 362/96 |
| 8,092,054 | B2 * | 1/2012 | Liu et al. | 362/373 |
| 8,100,562 | B2 * | 1/2012 | Gluszczak et al. | 362/294 |
| 8,541,932 | B2 * | 9/2013 | Horng | 313/46 |
| 8,610,339 | B2 * | 12/2013 | Fang et al. | 313/35 |
| 2009/0268468 | A1 * | 10/2009 | Liu | 362/294 |
| 2010/0133578 | A1 * | 6/2010 | Pickard et al. | 257/99 |
| 2010/0165632 | A1 * | 7/2010 | Liang | 362/294 |
| 2012/0287642 | A1 * | 11/2012 | Zeng | 362/294 |

FOREIGN PATENT DOCUMENTS

| | | | |
|---|---|---|---|
| CN | 201215303 | Y | 4/2009 |
| CN | 201401765 | Y | 2/2010 |
| CN | 201706458 | U | 1/2011 |
| TW | 200912187 | A | 3/2009 |
| TW | 200946826 | | 11/2009 |

OTHER PUBLICATIONS

Chinese Office Action of Chinese Patent Application No. 201110353981.4 dated Mar. 31, 2014.

* cited by examiner

*Primary Examiner* — Bao Q Truong

(74) *Attorney, Agent, or Firm* — Dugan & Dugan, PC

(57) ABSTRACT

A heat sink includes a main structure and a peripheral structure. The main structure includes a bottom surface and a wall portion. The wall portion surrounds the outer edge of the bottom surface. The wall portion has a plurality of vents. The peripheral structure surrounds the outer edge of the main structure. The peripheral structure has a plurality of first flow paths and a plurality of second flow paths. Each of the first flow paths is located adjacent to the outside of the wall portion. Each of the second flow paths is communicated to the bottom surface via the corresponding vent.

17 Claims, 4 Drawing Sheets

HEAT SINK AND LAMP USING THE SAME

RELATED APPLICATIONS

This application claims priority to Taiwan Application Serial Number 100139602, filed Oct. 31, 2011, which is herein incorporated by reference.

BACKGROUND

1. Field of Invention

The present invention relates to a heat sink and a lamp using the same.

2. Description of Related Art

There is a significant amount of energy consumption associated with conventional illumination techniques. As a result, the development of techniques to realize lighting energy savings is one of the most important areas of new energy technology research. High-power and high-brightness light-emitting diodes, which are semiconductor light sources, are increasingly being used. Light-emitting diodes have many advantages including high luminous efficiency, low energy use, long lifetime, being environmentally friendly (since no mercury is used), rapid start, good directionality, etc., and as a result, have the potential to fully replace conventional lighting sources.

In order to bring the foregoing advantages into play, the junction temperature of light-emitting diodes must be decreased as much as possible with the assistance of highly efficient heat-dissipating mechanisms. Failure to sufficiently decrease the junction temperature will result in the brightness and lifetime of light-emitting diode lamps to be greatly reduced. Moreover, not only is the energy-saving effect of the light-emitting diode lamps reduced, but also, the reliability of the light-emitting diode lamps is directly impacted when the junction temperature is not sufficiently reduced. In some instances, serious luminous decay performance occurs or the light-emitting diode lamps may even fail.

A passive heat-dissipating approach generally used in a conventional lamp involves installing a heat sink in the lamp. The surface of the heat sink is exposed to the ambient air, and heat is dissipated into the air by natural convection. Therefore, in order to meet the heat-dissipating requirements associated with a high-power and high-brightness light-emitting diode lamp and thereby enable the same to operate normally without luminous decay performance, a heat sink with a large heat-dissipating area must be used. In order to improve the heat-dissipating capability of a lamp, an active heat-dissipating approach may be employed. That is, a fan module can be installed in the lamp, and exhaust flow paths are correspondingly designed in the heat sink.

However, a conventional heat sink with exhaust flow paths always has a poor layout, sometimes resulting in incompatibility between the exhaust flow path layout and the positions or quantity of light emitters. As a consequence, low heat dissipation is achieved, and the brightness and light uniformity of the lamp are negatively affected. Therefore, many in the field are endeavoring to design exhaust flow paths in a heat sink in such a manner to effectively improve the brightness and light uniformity of the lamp.

SUMMARY

The invention provides an improved heat sink. A main structure of the heat sink is used as the primary area thereof of exhausting heat from heat sources of the lamp (i.e., light emitters of the lamp), and the first flow paths and the second flow paths are disposed on a peripheral structure formed around the outer edge of the main structure. Because the first flow paths and the second flow paths are disposed around the periphery of the main structure of the heat sink (i.e., there is no vent located at the center of the heat sink), the layout with respect to the positions and the quantity of the light emitters disposed on the main structure of the heat sink is not affected by the first flow paths and the second flow paths. Hence, the brightness and light uniformity of a lamp utilizing the heat sink of the invention can be effectively improved.

According to an embodiment of the invention, a heat sink includes a main structure and a peripheral structure. The main structure includes a bottom surface and a wall portion. The wall portion surrounds the outer edge of the bottom surface. The wall portion has a plurality of vents. The peripheral structure surrounds the outer edge of the main structure. The peripheral structure has a plurality of first flow paths and a plurality of second flow paths. Each of the first flow paths is located adjacent to the outside of the wall portion. Each of the second flow paths is communicated to the bottom surface via the corresponding vent.

The invention further provides an improved lamp. The lamp uses a fan module for the intake of air from outside of a lamp holder of the lamp into the accommodating trough of the lamp holder via the first flow paths disposed around the outer edge of the main structure of the heat sink. The intake air is then exhausted out of the lamp holder subsequently via vents of the main structure and the second flow paths after passing through the fan module along the bottom of the main structure. That is, the invention can form a complete circulation path to dissipate the heat generated by the light emitter, so that the heat is directed outside of the lamp. Air with a lower temperature from outside of a lamp holder is drawn into the lamp holder via the first flow paths of the periphery and air with a higher temperature is exhausted outside of the lamp holder via the second flow paths of the periphery.

According to an embodiment of the invention, a lamp includes a heat sink, a fan module, and a lamp holder. The heat sink includes a main structure and a peripheral structure. The main structure includes a bottom surface and a wall portion. The wall portion surrounds the outer edge of the bottom surface. The wall portion has a plurality of vents. The peripheral structure surrounds the outer edge of the main structure. The peripheral structure has a plurality of first flow paths and a plurality of second flow paths. Each of the first flow paths is located adjacent to the outside of the wall portion. Each of the second flow paths is communicated to the bottom surface via the corresponding vent. The fan module is engaged with the inner edge of the wall portion and faces the bottom surface. The lamp holder has an opening and an accommodating trough. The peripheral structure is engaged with the opening of the lamp holder, and the fan module is located in the accommodating trough. The fan module intakes air from outside of the lamp holder into the accommodating trough via the first flow paths, and the air is then exhausted out of the lamp holder via the vents and the second flow paths after passing through the fan module.

In an embodiment of the invention, the first flow paths and the second flow paths are equidistantly arranged in an alternating configuration.

In an embodiment of the invention, each of the first flow paths is located between two adjacent ones of the second flow paths and each of the second flow paths is located between two adjacent ones of the first flow paths.

In an embodiment of the invention, the main structure further includes a plurality of guide bumps located on the bottom surface, and each of the guide bumps is connected to the wall portion and between two adjacent vents.

In an embodiment of the invention, the fan module abuts against the guide bumps, so as to form a gap between the bottom surface and the fan module. The gap is communicated to the first flow paths via the fan module and the accommodating trough and is communicated to the second flow paths via the vents.

In an embodiment of the invention, the width of each of the guide bumps is gradually increased along a direction toward the wall portion.

In an embodiment of the invention, the shape of each of the guide bumps is Y-shaped, I-shaped, Herringbone-shaped, V-shaped, or triangular in shape.

In an embodiment of the invention, the main structure further includes a guide bump located at the center of the bottom surface. The guide bump has a plurality of extending portions. Each of the extending portions extends toward the wall portion. An imaginary line that extends from each of the extending portions reaches the wall portion at a location between two adjacent vents.

In an embodiment of the invention, the guide bump is substantially X-shaped.

In an embodiment of the invention, the main structure further includes a top surface located on the opposite side of the bottom surface of the main structure. The lamp further includes a light emitter and a lens structure. The light emitter is disposed at the top surface. The lens structure is disposed on the main structure and optically coupled to the light emitter.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
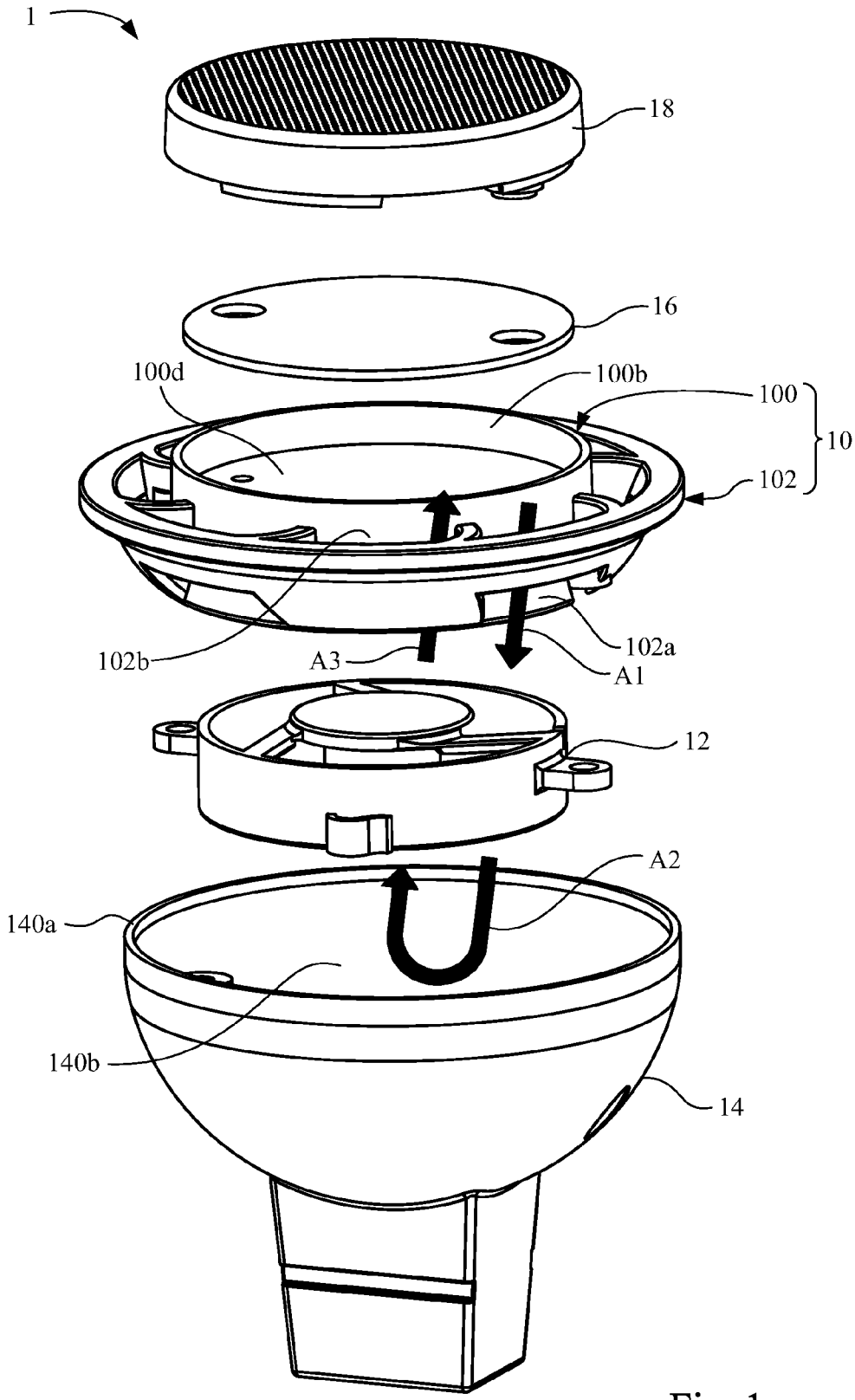
FIG. 1 is an exploded view of a lamp according to an embodiment of the invention.

Reference will now be made in detail to the present embodiments of the invention, examples of which are illustrated in the accompanying drawings. Wherever possible, the same reference numbers are used in the drawings and the description to refer to the same or like parts.

An improved lamp is provided. Specifically, a main structure of the heat sink of the lamp is used as the primary area thereof of exhausting heat from heat sources of the lamp (i.e., light emitters of the lamp), and the first flow paths and the second flow paths are disposed on a peripheral structure formed around the outer edge of the main structure. Because the first flow paths and the second flow paths are disposed around the periphery of the main structure of the heat sink (i.e., there is no vent located at the center of the heat sink), the layout with respect to the positions and the quantity of the light emitters disposed on the main structure of the heat sink is not affected by the first flow paths and the second flow paths. Hence, the brightness and light uniformity of a lamp utilizing the heat sink of the invention can be effectively improved.

Moreover, the lamp uses a fan module for the intake of air from outside of a lamp holder of the lamp into an accommodating trough of the lamp holder via the first flow paths disposed around the outer edge of the main structure of the heat sink. The intake air is then exhausted out of the lamp holder subsequently via vents of the main structure and the second flow paths after passing through the fan module along the bottom of the main structure. That is, the invention can form a complete circulation path to dissipate the heat generated by a light emitter(s) of the lamp, so that the heat is directed outside of the lamp. Air with a lower temperature from outside of a lamp holder is drawn into the lamp holder via the first flow paths of the periphery and air with a higher temperature is exhausted outside of the lamp holder via the second flow paths of the periphery.

FIG. 1 is an exploded view of a lamp 1 according to an embodiment of the invention.

As shown in FIG. 1, the lamp 1 includes a heat sink 10, a fan module 12, a lamp holder 14, a light emitter 16, and a lens structure 18. The fan module 12 of the lamp 1 can be engaged with the bottom of the heat sink 10. In an embodiment of the invention, in order to enhance the fastening strength between the fan module 12 and the heat sink 10, the fan module 12 can be fastened to the bottom of the heat sink 10 by screws, but the invention is not limited in this regard. The lamp holder 14 of the lamp 1 has an opening 140*a* and an accommodating trough 140*b*. The accommodating trough 140*b* of the lamp holder 14 is inwardly formed from the opening 140*a*. The outer edge of the heat sink 10 of the lamp 1 is suitable for being engaged with the opening 140*a* of the lamp holder 14, so that the fan module 12 is located in the accommodating trough 140*b* and between the heat sink 10 and the lamp holder 14. In an embodiment of the invention, in order to enhance the fastening stability among the fan module 12, the heat sink 10, and the lamp holder 14, positioning pins can be used to keep relative positions among these elements, but the invention is not limited in this regard. The light emitter 16 of the lamp 1 is disposed on the top of the heat sink 10. Therefore, the heat of the light emitter 16 of the lamp 1 generated during operation can be directly transferred to the heat sink 10 and then dissipated. The lens structure 18 of the lamp 1 is disposed on the heat sink 10 and optically coupled to the light emitter 16. The components included in the lamp 1 of the embodiment will be described in detail below.

Figure 2A:
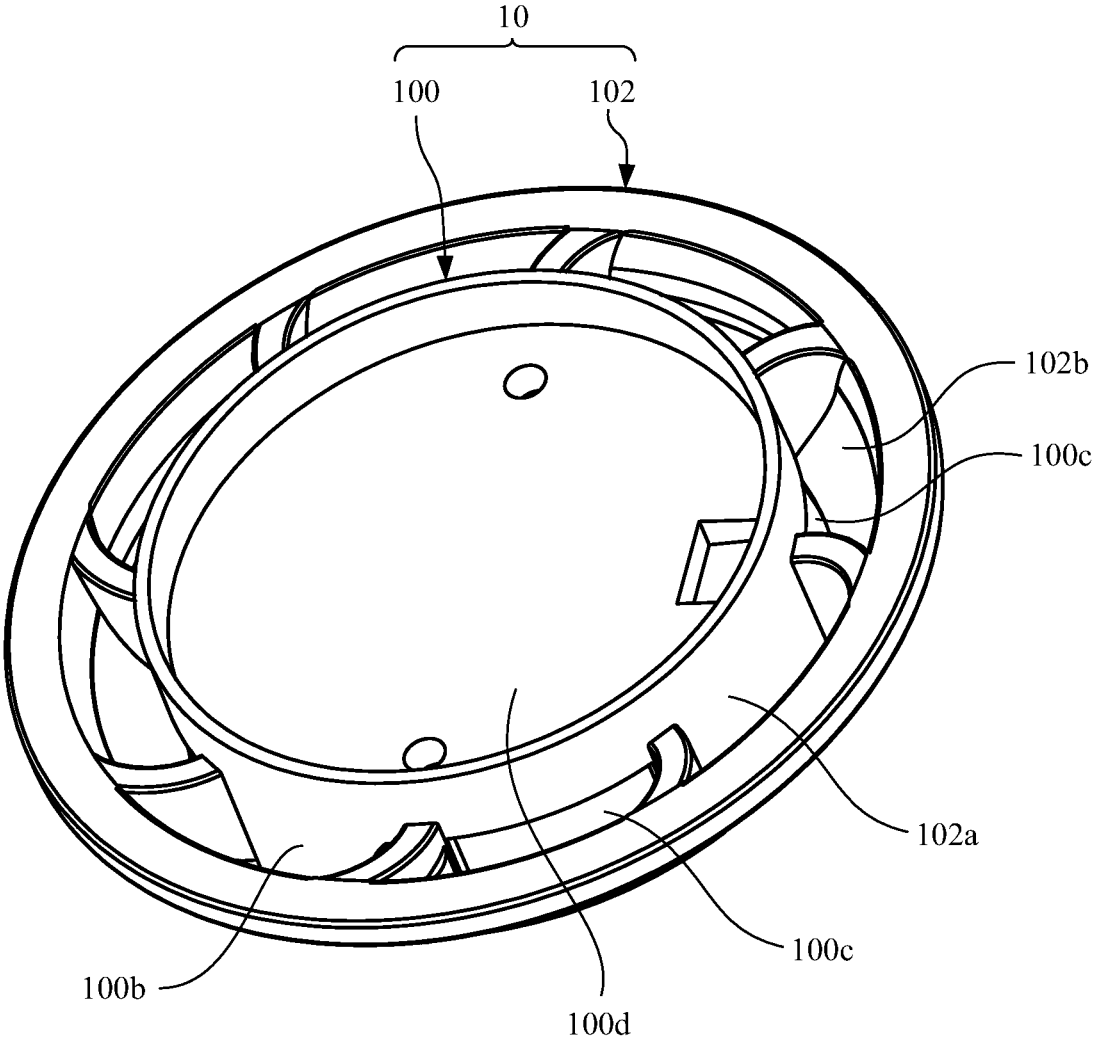
FIG. 2A is a stereogram view of the heat sink in FIG. 1.
Figure 2B:
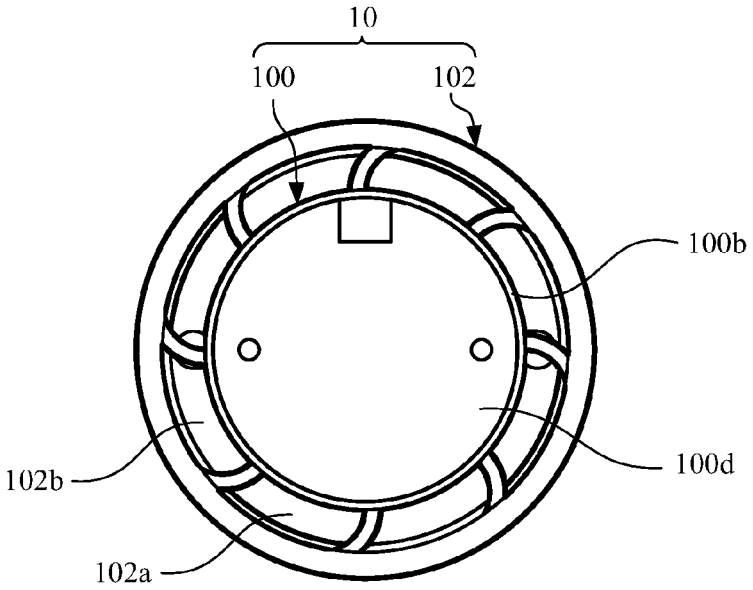
FIG. 2B is a top view of the heat sink in FIG. 1.
Figure 2C:
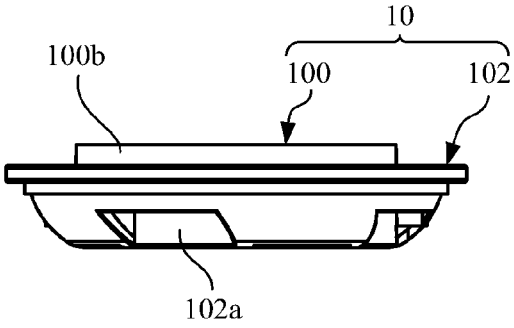
FIG. 2C is a side view of the heat sink in FIG. 1.
Figure 2D:
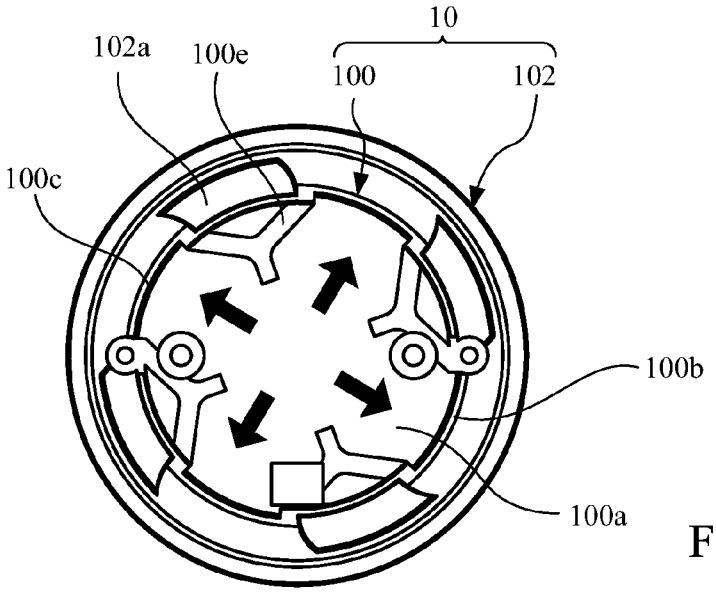
FIG. 2D is a bottom view of the heat sink in FIG. 1.

FIG. 2A is a stereogram view of the heat sink 10 in FIG. 1. FIG. 2B is a top view of the heat sink 10 in FIG. 1. FIG. 2C is a side view of the heat sink 10 in FIG. 1. FIG. 2D is a bottom view of the heat sink 10 in FIG. 1.

As shown in FIG. 2A to FIG. 2D in combination with FIG. 1, the heat sink 10 of the lamp 1 includes a main structure 100 and a peripheral structure 102. The main structure 100 of the heat sink 10 includes a top surface 100*d*, a bottom surface 100*a* (shown in FIG. 2D), and a wall portion 100*b*. The top surface 100*d* and the bottom surface 100*a* are located on opposite sides of the main structure 100. The wall portion 100*b* of the main structure 100 surrounds the outer edge of the top surface 100*d* and that of the bottom surface 100*a*. The light emitter 16 of the lamp 1 is disposed on the top surface 100*d* of the main structure 100. The lens structure 18 of the lamp 1 is disposed on the wall portion 100*b* of the main structure 100 and optically coupled to the light emitter 16. In an embodiment of the invention, the lens structure 18 of the lamp 1 is engaged with the wall portion 100*b* of the main structure 100 to thereby be secured thereto, but the invention is not limited in this regard. In the embodiment of the invention, the wall portion 100*b* of the main structure 100 extends along a direction perpendicular to the top surface 100*d* and the bottom surface 100*a*, but the invention is not limited in this regard.

The wall portion 100*b* of the main structure 100 has a plurality of vents 100*c*. The peripheral structure 102 of the heat sink 10 surrounds the outer edge of the main structure 100. The peripheral structure 102 of the heat sink 10 has a plurality of first flow paths 102*a* and a plurality of second flow paths 102*b*. Each of the first flow paths 102*a* of the peripheral structure 102 is located adjacent to the outside of the wall portion 100*b* of the main structure 100. Each of the second flow paths 102*b* of the peripheral structure 102 is communicated to the bottom surface 100*a* of the main structure 100 via the corresponding vent 100*c* on the wall portion 100*b*.

As shown in FIG. 1 in combination with FIG. 2A to FIG. 2D, the fan module 12 of the lamp 1 is engaged with the inner edge of the wall portion 100*b* of the main structure 100 and faces the bottom surface 100*a*. The light emitter 16 of the lamp 1 is disposed on the top surface 100*d* of the main structure 100. Therefore, the heat generated by the light emitter 16 of the lamp 1 is transferred to the bottom surface 100*a* of the main structure 100 from the top surface 100*d* of the main structure 100 and also to the peripheral structure 102 via the wall portion 100*b* of the main structure 100. The peripheral structure 102 of the heat sink 10 is engaged with the opening 140*a* of the lamp holder 14. Therefore, the fan module 12 of the lamp 1 can intake air with lower temperature from outside of the lamp holder 14 into the accommodating trough 140*b* via the first flow paths 102*a* of the peripheral structure 102 (as indicated by the flow direction A1 shown in FIG. 1). After passing through the fan module 12 along the flow direction A2 shown in FIG. 1, the intake air in the accommodating trough 140*b* will absorb the heat of the light emitter 16 that is transferred to the bottom surface 100*a* of the main structure 100 from the top surface 100*d* of the main structure 100, after which this air is then exhausted out of the lamp holder 14 along the bottom surface 100*a* and subsequently via the vents 100*c* of the wall portion 100*b* and the second flow paths 102*b* (as indicated by the flow direction A3 shown in FIG. 1), so as to form a complete circulation path. That is, the first flow paths 102*a* of the peripheral structure 102 are used to intake air, and the second flow paths 102*b* of the peripheral structure 102 are used to exhaust air.

It can be seen that there is no vent formed between the top surface 100*d* and the bottom surface 100*a* of the main structure 100 of the heat sink 10 in the invention. Accordingly, compared with conventional heat sinks, the light emitter 16 on the top surface 100*d* of the heat sink 10 of the invention has a greater area for installation of light sources. Therefore, the invention can achieve the effects of improving the brightness and light uniformity of the lamp 1.

As shown in FIG. 2A and FIG. 2B, the first flow paths 102*a* and the second flow paths 102*b* of the peripheral structure 102 are arranged in an alternating configuration. Preferably, the first flow paths 102*a* and the second flow paths 102*b* of the peripheral structure 102 are equidistantly arranged in an alternating configuration, so as to make the airflow more uniform while passing through the first flow paths 102*a* and the second flow paths 102*b*. That is, each of the first flow paths 102*a* of the peripheral structure 102 is located between two adjacent ones of the second flow paths 102*b*, and similarly, each of the second flow paths 102*b* is located between two adjacent ones of the first flow paths 102*a*. However, the invention is not limited in this regard, and the layout of the first flow paths 102*a* and the second flow paths 102 can be adjusted as needed according to actual design requirements. In an embodiment of the invention, in order to increase the heat-dissipating area of the heat sink 10, the first flow paths 102*a* and the second flow paths 102*b* of the peripheral structure 102 are arranged adjacent to the wall portion 100*b* while forming a tilt angle between the alignment of the first flow paths 102*a* and the second flow paths 102*b* of the peripheral structure 102 and the bottom surface 100*a* of the main structure 100. That is, in this embodiment of the invention, both the flow direction A1 along which the intake air is directed into the accommodating trough 140*b* by the fan module 12 of the lamp 1 and the flow direction A3 along which the air is exhausted out of the lamp holder 14 by the fan module 12 via the second flow paths 102*b* form helical flow of a tilt angle to the bottom surface 100*a* of the main structure 100, rather than forward direction flow being perpendicular to the bottom surface 100*a* of the main structure 100.

As shown in FIG. 2D in combination with FIG. 1, the main structure 100 of the heat sink 10 further includes a plurality of guide bumps 100*e*. The guide bumps 100*e* of the main structure 100 are located on the bottom surface 100*a*, and each of the guide bumps 100*e* of the main structure 100 is connected to the wall portion 100*b* and is disposed between two adjacent vents 100*c*. Furthermore, in the embodiment of the invention, each of the guide bumps 100*e* of the main structure 100 is connected to the wall portion 100*b* at a location that is close to the edges of two adjacent vents 100*c*. In other words, bilateral edge of each of the vents 100*c* on the wall portion 100*b* is connected between two adjacent guide bumps 100*e*. Moreover, when the fan module 12 of the lamp 1 is engaged with the inner edge of the wall portion 100*b* and abuts against the guide bumps 100*e*, a gap (not shown) is formed between the bottom surface 100*a* of the main structure 100 and the fan module 12. After the heat sink 10 of the lamp 1 is assembled to the lamp holder 14, the gap between the bottom surface 100*a* of the main structure 100 and the fan module 12 is communicated with the first flow paths 102*a* of the peripheral structure 102 via the fan module 12 and the accommodating trough 140*b* of the lamp holder 14, and is communicated with the second flow paths 102*b* via the vents 100*c* on the wall portion 100*b*.

Therefore, after passing through the fan module 12 along the flow direction A2, the intake air that is directed into the accommodating trough 140*b* will absorb the heat of the light emitter 16 that is transferred to the bottom surface 100*a* of the main structure 100 from the top surface 100*d* of the main structure 100 at the gap between the bottom surface 100*a* of the main structure 100 and the fan module 12. Subsequently, the air flows toward the vents 100*c* on the wall portion 100*b* along the bottom surface 100*a* while being guided by the guide bumps 100*e* (as indicated by the arrows shown in FIG. 2D), and then is exhausted out of the lamp holder 14 via the second flow paths 102*b* (as indicated by the flow direction A3 shown in FIG. 1).

As shown in FIG. 2D, the width of each of the guide bumps 100*e* of the main structure 100 is gradually increased along a direction toward the wall portion 100*b* of the main structure 100, so that each of the guide bumps 100*e* of the main structure 100 can guide the air in the gap between the bottom surface 100*a* of the main structure 100 and the fan module 12 to two adjacent vents 100*c*. Furthermore, in the embodiment of the invention, each of the guide bumps 100*e* of the main structure 100 is Y-shaped or V-shaped, so that the heat-dissipating area can be increased, but the invention is not limited in this regard. In other embodiments, each of the guide bumps 100*e* of the main structure 100 can be I-shaped, Herringbone-shaped, V-shaped, triangular in shape, etc.

Figure 3:
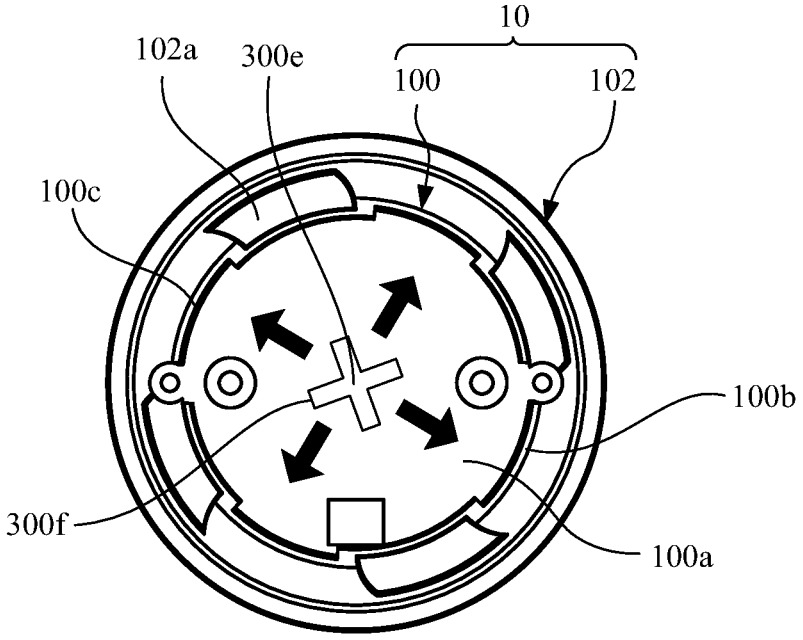
FIG. 3 is a bottom view of another embodiment of the heat sink in FIG. 1.

FIG. 3 is a bottom view of another embodiment of the heat sink 10 in FIG. 1.

As shown in FIG. 3, the main structure 100 of the heat sink 10 further includes a guide bump 300*e*. The guide bump 300*e* of the main structure 100 is located at the center of the bottom surface 100*a*. The guide bump 300*e* of the main structure 100 has a plurality of extending portions 300*f*. Each of the extending portions 300*f* of the guide bump 300*e* extends toward two adjacent vents 100*c* of the wall portion 100*b*. In this embodiment, each of the extending portions 300*f* extends part of the distance to the wall portion 100*b* without reaching the same. An imaginary line extending from each of the extending portions 300*f* reaches the wall portion 100*b* at a location between two adjacent vents 100*c*. As a result of this configuration, each of the vents 100*c* on the wall portion 100*b* faces toward two adjacent extending portions 300*f*.

Therefore, after passing through the fan module 12 along the flow direction A2 shown in FIG. 1, the intake air that is directed into the accommodating trough 140*b* will absorb the heat of the light emitter 16 that is transferred to the bottom surface 100*a* of the main structure 100 from the top surface 100*d* of the main structure 100 at the gap between the bottom surface 100*a* of the main structure 100 and the fan module 12. Subsequently, the air flows toward the vents 100*c* on the wall portion 100*b* along the center of the bottom surface 100*a* through the guidance of the guide bump 300*e* (as indicated by the arrows shown in FIG. 3) and then is exhausted out of the lamp holder 14 via the second flow paths 102*b* (as indicated by the flow direction A3 shown in FIG. 1).

In an embodiment of the invention, the height of each of the guide bumps 100*e* of the main structure 100 (see FIG. 2D) opposing to the bottom surface 100*a* is preferably 3 mm, but the invention is not limited in this regard. In an embodiment of the invention, the height of the fan module 12 of the lamp 1 is preferably 7 mm, but the invention is not limited in this regard.

In an embodiment of the invention, the lamp 1 can further include a circuit board (not shown). The circuit board of the lamp 1 can be disposed in the accommodating trough 140*b* of the lamp holder 14 and can be electrically connected to the light emitter 16 that is disposed on the top surface 100*d* of the main structure 100.

In an embodiment of the invention, the light source used by the light emitter 16 of the lamp 1 can be a light-emitting diode or an organic light-emitting diode, but the invention is not limited in this regard.

The heat sink 10 of the invention is shown in FIG. 1 in a state applied to an MR (multifaceted reflector) series directional lamp, i.e., the lamp 1 is an MR series directional lamp. However, the invention is not limited in this regard. The heat sink 10 of the invention can be used in various different kinds of omnidirectional lamps, decorative lamps, or directional lamps.

According to the foregoing recitations of the embodiments of the invention, it can be seen that a main structure of the heat sink of the invention is used as the primary area thereof of exhausting heat from heat sources of the lamp (i.e., light emitters of the lamp), and the first flow paths and the second flow paths are disposed on a peripheral structure formed around the outer edge of the main structure. Because the first flow paths and the second flow paths are disposed around the periphery of the main structure of the heat sink (i.e., there is no vent located at the center of the heat sink), the layout with respect to the positions and the quantity of the light emitters disposed on the main structure of the heat sink is not affected by the first flow path and the second flow paths. Hence, the brightness and light uniformity of a lamp utilizing the heat sink of the invention can be effectively improved.

Moreover, the lamp uses a fan module for the intake of air from outside of a lamp holder of the lamp into the accommodating trough of the lamp holder via the first flow paths disposed around the outer edge of the main structure of the heat sink. The intake air is then exhausted out of the lamp holder subsequently via vents of the main structure and the second flow paths after passing through the fan module along the bottom of the main structure. That is, the invention can form a complete circulation path to dissipate the heat generated by the light emitter, so that the heat is directed outside of the lamp. Air with a lower temperature from outside of a lamp holder is drawn into the lamp holder via the first flow paths of the periphery and air with a higher temperature is exhausted outside of the lamp holder via the second flow paths of the periphery.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A heat sink comprising:

a main structure including a bottom surface and a wall portion, the wall portion surrounding an outer edge of the bottom surface, the wall portion having a plurality of vents, wherein the main structure further includes a plurality of guide bumps located on the bottom surface, and each of the guide bumps is connected to the wall portion and disposed between two adjacent vents; and a peripheral structure surrounding an outer edge of the main structure, the peripheral structure having a plurality of first flow paths and a plurality of second flow paths, each of the first flow paths being located adjacent to the outside of the wall portion, each of the second flow paths being communicated to the bottom surface via the corresponding vent.

2. The heat sink of claim 1, wherein the first flow paths and the second flow paths are equidistantly arranged in an alternating configuration.

3. The heat sink of claim 2, wherein each of the first flow paths is located between two adjacent ones of the second flow paths and each of the second flow paths is located between two adjacent ones of the first flow paths.

4. The heat sink of claim 1, wherein the width of each of the guide bumps is gradually increased along a direction toward the wall portion.

5. The heat sink of claim 4, wherein each of the guide bumps is Y-shaped, I-shaped, Herringbone-shaped, V-shaped, or triangular in shape.

6. A lamp comprising:

a heat sink comprising:

a main structure comprising a bottom surface and a wall portion, the wall portion surrounding the outer edge of the bottom surface, the wall portion having a plurality of vents; and a peripheral structure surrounding the outer edge of the main structure, the peripheral structure having a plurality of first flow paths and a plurality of second flow paths, each of the first flow paths being located adjacent to the outside of the wall portion, each of the second flow paths being communicated to the bottom surface via the corresponding vent;

a fan module engaged with the inner edge of the wall portion and facing the bottom surface; and a lamp holder having an opening and an accommodating trough, wherein the peripheral structure is engaged with the opening of the lamp holder, and the fan module is located in the accommodating trough;

wherein the fan module intakes air from outside of the lamp holder into the accommodating trough via the first flow paths, and the air is then exhausted out of the lamp holder via the vents and the second flow paths after passing through the fan module.

7. The lamp of claim 6, wherein the first flow paths and the second flow paths are equidistantly arranged in an alternating configuration.

8. The lamp of claim 7, wherein each of the first flow paths is located between two adjacent ones of the second flow paths and each of the second flow paths is located between two adjacent ones of the first flow paths.

9. The lamp of claim 6, wherein the main structure further comprises a plurality of guide bumps located on the bottom surface, and each of the guide bumps is connected to the wall portion and disposed between two adjacent vents.

10. The lamp of claim 9, wherein the fan module abuts against the guide bumps, so as to form a gap between the bottom surface and the fan module, and the gap is communicated to the first flow paths via the fan module and the accommodating trough and is communicated to the second flow paths via the vents.

11. The lamp of claim 9, wherein the width of each of the guide bumps is gradually increased along a direction toward the wall portion.

12. The lamp of claim 11, wherein each of the guide bumps is Y-shaped, I-shaped, Herringbone-shaped, V-shaped, or triangular in shape.

13. The lamp of claim 6, wherein the main structure further comprises a guide bump located at the center of the bottom surface, the guide bump has a plurality of extending portions, and each of the extending portions extends toward the wall portion, an imaginary line that extends from each of the extending portions reaching the wall portion at a location between two adjacent vents.

14. The lamp of claim 13, wherein the guide bump is substantially X-shaped.

15. The lamp of claim 6, wherein the main structure further comprises a top surface located on the opposite side of the bottom surface of the main structure, and the lamp further comprises:

a light emitter disposed at the top surface; and a lens structure disposed on the main structure and optically coupled to the light emitter.

16. A heat sink comprising:

a main structure including a bottom surface and a wall portion, the wall portion surrounding an outer edge of the bottom surface, the wall portion having a plurality of vents, wherein the main structure further includes a guide bump located at a center of the bottom surface, the guide bump having a plurality of extending portions, each of the extending portions extending toward the wall portion, an imaginary line that extends from each of the extending portions to the wall portion at a location between two adjacent vents; and a peripheral structure surrounding an outer edge of the main structure, the peripheral structure having a plurality of first flow paths and a plurality of second flow paths, each of the first flow paths being located adjacent the outside of the wall portion, each of the second flow paths being communicated to the bottom surface via the corresponding vent.

17. The heat sink of claim 16, wherein the guide bump is substantially X-shaped.

* * * * *